US005160424A

United States Patent [19]

Le et al.

[11] Patent Number: 5,160,424

[45] Date of Patent: Nov. 3, 1992

[54] HYDROCARBON CRACKING, DEHYDROGENATION AND ETHERIFICATION PROCESS

[75] Inventors: Q. N. Le, Cherry Hill; H. Owen, Belle Mead, both of N.J.; P. H. Schipper, Wilmington, Del.

[73] Assignee: Mobil Oil Corporation, Fairfax, Va.

[21] Appl. No.: 612,932

[22] Filed: Nov. 13, 1990

Related U.S. Application Data

[63] Continuation-in-part of Ser. No. 442,806, Nov. 29, 1989, Pat. No. 4,969,987.

[51] Int. Cl.[5] ..... C10G 57/00; C07C 4/06

[52] U.S. Cl. ..... 208/67; 208/120; 585/310; 585/324; 585/649; 585/653; 585/654; 568/697

[58] Field of Search ..... 208/67, 120; 585/310, 585/324, 649, 653, 654; 568/697

[56] References Cited

U.S. PATENT DOCUMENTS

| | | | |
|---|---|---|---|
| 3,926,781 | 12/1975 | Gale | 208/117 |
| 4,423,251 | 12/1983 | Pujado et al. | 568/697 |
| 4,827,045 | 5/1989 | Harandi et al. | 568/697 |
| 4,969,987 | 11/1990 | Le et al. | 208/67 |
| 5,100,534 | 3/1992 | Le et al. | 208/70 |

*Primary Examiner*—Anthony McFarlane
*Assistant Examiner*—Nhat Phan
*Attorney, Agent, or Firm*—Alexander J. McKillop; Charles J. Speciale; L. G. Wise

[57] ABSTRACT

A method for upgrading paraffinic naphtha to high octane fuel by contacting a feedstock, such as C7–C22 fresh virgin naphtha, with porous acid cracking catalyst under low pressure selective cracking conditions effective to produce C4 –C5 isoalkenes and C4–C5 isoalkanes. The preferred feedstock is straight run naphtha containing C7+ alkanes, at least 15 wt % C7+ cycloaliphatic hydrocarbons and less than 20% aromatics, which can be converted with a fluidized zeolite catalyst in a vertical riser reactor during a short contact period.

The isoalkane products of cracking are dehydrogenated and etherified to provide high octane fuel components.

17 Claims, 1 Drawing Sheet

FIG.
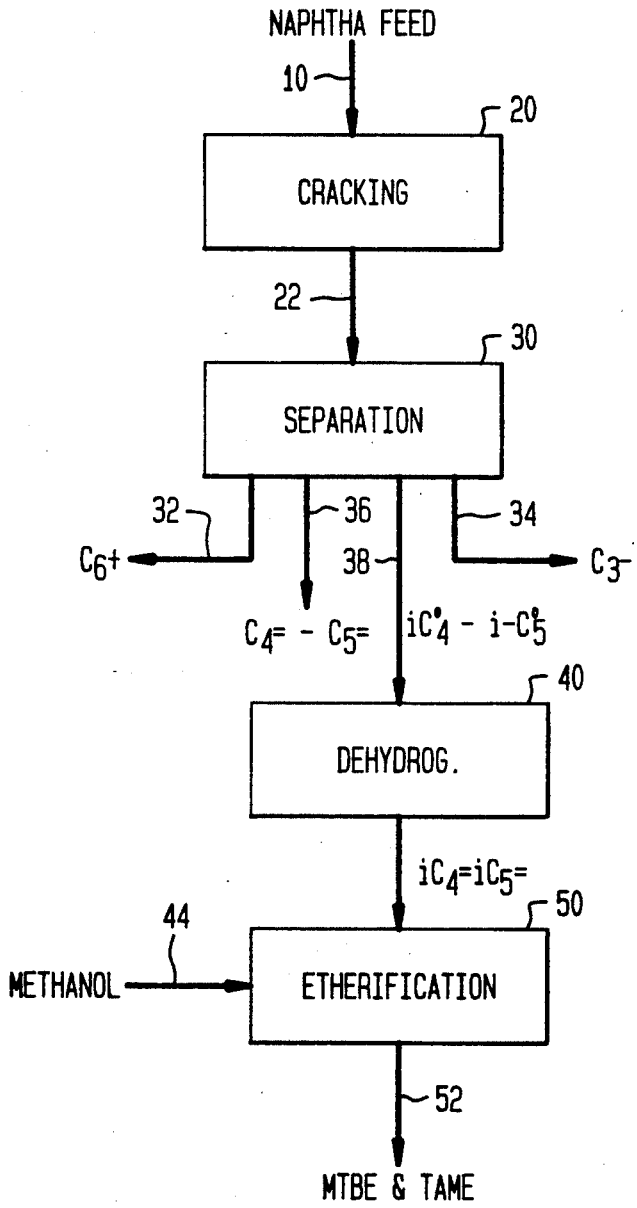

HYDROCARBON CRACKING, DEHYDROGENATION AND ETHERIFICATION PROCESS

REFERENCE TO COPENDING APPLICATION

This application is a continuation in part of U.S. patent application Ser. No. 07/442,806 filed Nov. 29, 1989, now U.S. Pat. No. 4,969,987, incorporated herein by reference.

BACKGROUND OF THE INVENTION

This invention relates to production of high octane fuel from naphtha by hydrocarbon cracking to produce isomeric intermediate paraffins, and subsequent upgrading to make ethers. In particular, it relates to methods and reactor systems for cracking $C_7$+ paraffinic and naphthenic feedstocks, such as naphthenic petroleum fractions, under selective reaction conditions to produce intermediates rich in C4–C5 isoalkanes.

There has been considerable development of processes for synthesizing alkyl tertiary-alkyl ethers as octane boosters in place of conventional lead additives in gasoline. The etherification processes for the production of methyl tertiary alkyl ethers, in particular methyl t-butyl ether (MTBE) and t-amyl methyl ether (TAME) have been the focus of considerable research. It is known that isobutylene (i-butene) and other isoalkenes (branched olefins) may be reacted with methanol, ethanol, isopropanol and other lower aliphatic primary and secondary alcohols over an acidic catalyst to provide tertiary ethers. Methanol is considered the most important $C_1$–$C_4$ oxygenate feedstock because of its widespread availability and low cost. Therefore, primary emphasis herein is placed on MTBE and TAME and cracking processes for making isobutylene and isoamylene reactants for etherification.

In current refining strategies naphtha reforming provides a major source of high octane gasoline containing very high aromatic levels, including benzene. In the present integrated process, the naphtha feedstock is first partially converted in a cracking reactor containing large-pore zeolite catalysts to obtain a mixture of light olefins and iso-paraffins. The iso-paraffins such as isobutane and iso-pentane are separated from the product gas mixture and then dehydrogenated to corresponding iso-butylene and iso-amylene. The naphtha cracking-/dehydrogenation process yields very high amount of light olefins, particularly $iC_4$- and $iC_5$- for downstream MTBE/TAME production. This processing sequence produces high octane gasoline components while minimizing the overall aromatic content of gasoline pool.

SUMMARY OF THE INVENTION

A novel process and operating technique has been found for upgrading paraffinic feedstock such as $C_7$+ naphthenic naphtha to high octane fuel. The primary reaction for conversion of naphtha is effected by contacting the hydrocarbon feedstock with acid zeolite cracking catalyst under low pressure selective cracking conditions and reaction temperature of about 425° to 650° C. to provide at least 10 wt % selectivity to C4-C5 isoaliphatics. Preferably, the cracking catalyst comprises large or medium pore aluminosilicate zeolite selected from ZSM-5, ZSM-11, ZSM-12, MCM-22, zeolite beta, USY and mixtures thereof with one another, said cracking catalyst being substantially free of hydrogenation-dehydrogenation metal components.

Cracking effluent is separated to obtain a light olefinic fraction rich in C4–C5 isoalkenes, an intermediate paraffin fraction rich in C4–C5 isoalkanes, and a C6+ liquid fraction of increased octane value, said cracking effluent containing less than 5 wt % C2- light cracked gas. Isobutene and isopentene net production is optimized by dehydrogenating the intermediate paraffin fraction to obtain additional C4–C5 isoalkenes. With large pore zeolites or mixtures thereof the cracking-dehydrogenation reactions can be controlled to produce at least 40% selectivity of total C4–C5 isoalkenes based on weight of converted naphtha. The preferred fresh feedstock is selected from virgin straight run petroleum naphtha, hydrocracked naphtha, coker naphtha, visbreaker naphtha, and reformer extract raffinate containing at least 15 wt % C7+ cycloaliphatic hydrocarbons and about 1 to 40% aromatics; and the cracking conditions include total pressure up to about 500 kPa, said aluminosilicate zeolite having an acid cracking activity less than 15.

These and other objects and features of the invention will be understood from the following description and in the drawing.

DRAWING

FIG. 1 of the drawing is a schematic flow sheet depicting a multireactor cracking, dehydrogenation and etherification system depicting the present invention.

DETAILED DESCRIPTION

Typical naphtha feedstock materials for selective cracking are produced in petroleum refineries by distillation of crude oil. Typical straight run naphtha fresh feedstock usually contains at least about 10 wt % (preferably 20 to 30%) C7–C12 normal and branched alkanes, at least about 20% (preferably about 30 to 50%) C7+ cycloaliphatic (i.e., naphthene) hydrocarbons, and 1 to 40% (preferrably less than 20%) aromatics. The C7–C12 hydrocarbons have a normal boiling range of about 65° to 175° C. The process can utilize various feedstocks such as cracked FCC naphtha, hydrocracked naphtha, coker naphtha, visbreaker naphtha and reformer extraction (Udex) raffinate, including mixtures thereof. For purposes of explaining the invention, discussion is directly mainly to virgin naphtha and methanol feedstock materials.

Referring to FIG. 1 of the drawing, the operational sequence for a typical naphtha conversion process is shown, wherein fresh virgin straight run naphtha feedstock 10 or hydrocracked naphtha is passed to a cracking reactor unit 20, from which the effluent 22 is distilled in separation unit 30 to provide a liquid C6+ hydrocarbon stream 32 containing unreacted naphtha, heavier olefins, etc., a light C3- offgas stream 34, and cracked intermediate hydrocarbon rich in C4 and C5 linear and branched aliphatics, including isoparaffins and tertiary olefins. The C4–C5 hydrocarbons can be recovered from separation unit as a mixture of olefins and paraffins; however, it is desirable to further separate the C4–C5 olefin 36 stream by selective extraction to obtain the tertiary i-butene and i-pentenes, usually with non-etherifiable butylenes and amylenes.

The isoparaffin rich hydrocabon stream 38 contains isobutane and isopentane, which are converted to corresponding olefins in dehydrogenation unit 40 to provide an effluent stream 42 rich in etherifiable tertiary isobutylene and isopentene.

At least the C4–C5 isoalkene-containing fraction of effluent stream 34 can be etherified along with olefins from stream 42 by reaction with methanol or other alcohol stream 44 in etherification reactor unit 50 by contacting the reactants with an acid catalyst, usually in a fixed bed process, to produce an effluent stream 52 containing MTBE, TAME and unreacted C5- components. Conventional product recovery operations, such as distillation, extraction, etc. can be employed to recover the MTBE/TAME ether products as pure materials, or as a C5+ mixture for fuel blending. Unreacted light olefinic components, methanol and any other C2–C5 aliphatics may be further upgraded by catalytic conversion.

Primary Stage- Zeolite Selective Cracking Catalysts

Careful selection of catalyst components to optimize isoalkane-isoalkene selectivity is important to overall success of the integrated process. It is found that catalyst containing at least one porous catalyst component having a pore size greater than 7 Å can result in greatly enhanced iso-butane/isopentane selectivity. Under certain circumstances it is feasible to employ the same catalyst for naphtha cracking and downstream optional olefin upgrading, although these operations may be kept separate with different catalysts being employed.

Large pore zeolites, such as Y, beta, mordenite, or others having a pore size greater than 7 Å are most desirable. The cracking catalyst may consist essentially of ultrastable zeolite Y (USY), beta, ZSM-12, MCM-22 or the like, having an acid cracking activity less than 15 (standard alpha value) and low constraint index (C.I.=0.4–2 or lower). Medium pore zeolites have a pore size of about 5–7 Å, able to accept naphthene components found in most straight run naphtha from petroleum distillation or other alkyl cycloaliphatics. When cracking substantially linear alkanes, the more constrained medium pore structure may be advantageous, especially in admixture with larger pore catalyst components.

Prominent among the intermediate pore size zeolites is ZSM-5, which is usually synthesized with Bronsted acid active sites by incorporating a tetrahedrally coordinated metal, such as Al, Ga, Fe, B or mixtures thereof, within the zeolitic framework. These medium pore zeolites useful for acid catalysis; however, the advantages of medium pore structures may be utilized by employing highly siliceous materials or crystalline metallosilicate having one or more tetrahedral species having varying degrees of acidity. ZSM-5 crystalline structure is readily recognized by its X-ray diffraction pattern, which is described in U.S. Pat. No. 3,702,866 (Argauer, et al.), incorporated by reference.

Zeolite hydrocarbon upgrading catalysts use herein may include a minor portion of the medium pore crystalline aluminosilicate zeolites having a silica-to-alumina ratio of at least 12, a constraint index of about 0.5 to 12 and acid cracking activity (alpha value) of about 1–15 based on total catalyst weight. Representative of the medium pore zeolites are ZSM-5, ZSM-11, ZSM-12, ZSM-22, ZSM-23, ZSM-35, ZSM-48, Zeolite Beta, L, MCM-22, SSZ-25 and mixtures thereof with similarly structured catalytic materials. Aluminosilicate ZSM-5 is disclosed in U.S. Pat. No. 3,702,886 and U.S. Pat. No. Re. 29,948. Other suitable zeolites are disclosed in U.S. Pat. Nos. 3,709,979; 3,832,449; 4,076,979; 3,832,449; 4,076,842; 4,016,245; 4,414,423; 4,417,086; 4,517,396; 4,542,257; and 4,826,667. MCM-22, which is believed to have both large pores and medium pores and C.I.=1.5, is disclosed U.S. Pat. No. 4,954,325 (Rubin and Chu). These disclosures are incorporated herein by reference. While suitable zeolites having a coordinated metal oxide to silica molar ratio of 20:1 to 500:1 or higher may be used, it is advantageous to employ a standard ZSM-5 or ZSM-12, suitably modified if desired to adjust acidity. A typical zeolite catalyst component having Bronsted acid sites may consist essentially of aluminosilicate zeolite with 5 to 95 wt. % silica and/or alumina binder.

Usually the zeolite crystals have a crystal size from about 0.01 to 2 microns or more. In order to obtain the desired particle size for fluidization in the turbulent regime, the zeolite catalyst crystals are bound with a suitable inorganic oxide, such as silica, alumina, etc. to provide a zeolite concentration of about 5 to 95 wt %.

It is advantageous to employ a standard zeolite having a silica:alumina molar ratio of 25:1 or greater in a once-through fluidized bed unit to convert 20 to 70 percent, preferably at least 30 wt. %, of the hydrocarbon feedstock in a single pass. Particle size distribution can be a significant factor in transport fluidization and in achieving overall homogeneity in dense bed, turbulent regime or transport fluidization. It is desired to operate the process with particles that will mix well throughout the bed. It is advantageous to employ a particle size range consisting essentially of 1 to 150 microns. Average particle size is usually about 20 to 100 microns In addition to the commercial zeolites, acid catalysis can be achieved with aluminophosphates (ALPO), silicoaluminophosphates (SAPO) or other non-zeolitic porous acid catalysts.

Fluidized Catalyst Riser Reactor Cracking Operation

The selective cracking conditions include total pressure up to about 500 kPa and reaction temperature of about 425° to 650° C., preferrably at pressure less than 175 kPa and temperature in the range of about 450° to 540° C., wherein the cracking reaction produces less than 5% C2- light gas based on fresh naphtha feedstock.

The cracking reaction severity is maintained by employing a weight hourly space velocity of about 1 to 100 (WHSV based on active catalyst solids) and contact time less than 10 seconds, usually about 0.5–2 sec. While fixed bed, moving bed or dense fluidized bed catalyst reactor systems may be adapted for the cracking step, it is preferred to use a vertical riser reactor with fine catalyst particles being circulated in a fast fluidized bed.

Effluent Separation

Cracking effluent preferably is separated to obtain a light olefinic fraction rich in C4–C5 isoalkenes, an intermediate paraffinic fraction rich in C4–C5 isoalkanes, and a C6+ liquid fraction of increased octane value. The cracking effluent contains less than 5 wt % C2- light cracked gas byproduct, which is readily recovered from the desired products by flashing, stripping, etc. Heavier effluent components, such as gasoline range hydrocarbons containing six or more carbon atoms are easily separated from C5- components by distillation. Paraffins in the intermediate range, rich in isobutane and isopentane, can be separated from olefins by selective extraction techniques known in the art. The paraffinic intermediate may be dehydrogenated to convert both isoalkanes and n-alkanes or the isoalkanes may be enriched prior to dehydrogenation. Since n-alkenes are substantially unreactive with primary and secondary alcohols in etherification reactions to produce tertiary alkyl ethers, it is feasible to pass these materials through with the isomeric aliphatic hydrocarbons.

Dehydrogenation Operations

An important unit operation in the conversion of iso-paraffins to their corresponding iso-olefins is dehydrogenation. Conventionally this can be achieved by high temperature cracking using hydrogenation-dehydrogenation catalyst; however, it is within the inventive concept to employ transhydrogenation in this process step to effect removal of hydrogen from the C3–C5 intermediate alkanes. Various processes are known for producing isoalkene-rich by dehydrogenation (including isomerization processes), such as discloses in U.S. Pat. No. 4,393,250 (Gottlieb et al). Typical processes are operated at elevated temperature (about 530°–700° C.) and moderate pressure using an active alumina solid catalyst impregnated with Pt or Cr oxide. Other dehydrogenation techniques are disclosed in Oil & Gas Journal, Dec. 8, 1980, pp 96–101; Hydrocarbon Processing, April 1982, pp 171–4; U.S. Pat. No. 4,925,455 (Harandi et al/ Dkt5255) and in U.S. Pat. No. 4,216,346 (Antos).

Etherificaton Operation

The reaction of methanol with isobutylene and isoamylenes at moderate conditions with a resin catalyst is known technology, as provided by R. W. Reynolds, et al., *The Oil and Gas Journal*, Jun. 16, 1975, and S. Pecci and T. Floris, *Hydrocarbon Processing*, December 1977. An article entitled "MTBE and TAME—A Good Octane Boosting Combo", by J. D. Chase, et al., *The Oil and Gas Journal*, Apr. 9, 1979, pages 149–152, discusses the technology. A preferred catalyst is a sulfonic acid ion exchange resin which etherifies and isomerizes the reactants. A typical acid catalyst is Amberlyst 15 sulfonic acid resin.

Processes for producing and recovering MTBE and other methyl tert-alkyl ethers for $C_4$–$C_7$ iso-olefins are known to those skilled in the art, such as disclosed in U.S. Pat. No. 4,788,365 (Owen et al) and in U.S. Pat. No. 4,885,421, incorporated by reference. Various suitable extraction and distillation techniques are known for recovering ether and hydrocarbon streams from etherification effluent; however, it is advantageous to convert unreacted methanol and other volatile components of etherificaton effluent by zeolite catalysis.

Fluidized Bed Olefin Upgrading Reactor Operation

Zeolite catalysis technology for optional terminal stage upgrading of lower aliphatic hydrocarbons and oxygenates to liquid hydrocarbon products can be employed. Commercial aromatization (M2-Forming) and Mobil Olefin to Gasoline/Distillate (MOG/D) processes employ shape selective medium pore zeolite catalysts for these olefin upgrading processes. It is understood that the terminal stage zeolite conversion unit operation can have the characteristics of these catalysts and processes to produce a variety of hydrocarbon products, especially liquid aliphatic and aromatics in the $C_5$–$C_9$ gasoline range.

In addition to the methanol and olefinic components of the reactor feed, suitable olefinic supplemental feedstreams may be added to the preferred olefin upgrading reactor unit. Non-deleterious components, such as lower paraffins and inert gases, may be present. The reaction severity conditions can be controlled to optimize yield of $C_3$–$C_5$ paraffins, olefinic gasoline or $C_6$–$C_8$ BTX hydrocarbons, according to product demand. Reaction temperatures and contact time are significant factors in the reaction severity, and the process parameters are followed to give a substantially steady state condition wherein the reaction severity is maintained within the limits which yield a desired weight ratio of propane to propene in the reaction effluent.

In a dense bed or turbulent fluidized catalyst bed the conversion reactions are conducted in a vertical reactor column by passing hot reactant vapor or lift gas upwardly through the reaction zone at a velocity greater than dense bed transition velocity and less than transport velocity for the average catalyst particle. A continuous process is operated by withdrawing a portion of coked catalyst from the reaction zone, oxidatively regenerating the withdrawn catalyst and returning regenerated catalyst to the reaction zone at a rate to control catalyst activity and reaction severity to effect feedstock conversion.

Upgrading of olefins is taught by Owen et al in U.S. Pat. Nos. 4,788,365 and 4,090,949, incorporated herein by reference. In a typical process, the methanol and olefinic feedstreams are converted in a catalytic reactor under elevated temperature conditions and suitable process pressure to produce a predominantly liquid product consisting essentially of $C_6$+ hydrocarbons rich in gasoline-range paraffins and aromatics. The reaction temperature for olefin upgrading can be carefully controlled in the operating range of about 250° C. to 650° C., preferably at average reactor temperature of 300° C. to 600° C.

The following examples illustrate the integrated process.

EXAMPLE 1

Naphtha cracking were performed in a small scale fixed-bed reactor. In a ⅜" ID. isothermal tubular reactor, 5 grams of various catalysts (14/25 mesh) were heated to 1000° F. under nitrogen and maintained at this temperature and 50 psig for 18 hours. To commence the cracking reaction, an Arabian Light $C_6$–350° F. straight run naphtha was charged to the reactor at 6 WHSV. Nitrogen flow rate was sufficient to maintain contact times of approximately 1 second. Liquid was fed to the reactor for 30 minutes, followed by 30 minutes of nitrogen purging before resumption of the liquid feed. Conversion values were based on the amount of $C_5$- products produced.

Several zeolite catalysts were evaluated for naphtha cracking experiments. The catalysts were in alumina extrudate form containing about 65 wt % zeolite component.

The zeolites evaluated have an intermediate pore including ZSM-5 and ZSM-12 and large pore such as USY.

The results from naphtha cracking studies are shown in Table 1.

TABLE 1

Product Distribution Obtained from Selective Cracking of Straight Run Naphtha Over ZSM-5, ZSM-12 and USY

| | Catalyst | | |
|---|---|---|---|
| | ZSM-5 | ZSM-12 | USY |
| | Example | | |
| | 1A | 1B | 1C |
| $C_5$— Conversion, wt % | 43 | 43 | 48 |
| Product Selectivity, wt % | | | |
| $C_2$= | 11.4 | 5.1 | 3.9 |
| $C_3$= | 26.7 | 28.5 | 21.9 |
| $C_4$= | 21.2 | 24.1 | 15.8 |
| $C_5$= | 6.3 | 8.3 | 5.6 |
| Total $C_2$=-$C_5$= | 65.6 | 66.0 | 47.2 |
| Total $iC_4$=-$iC_5$= | 12.5 | 16.6 | 9.3 |

TABLE 1-continued

Product Distribution Obtained from Selective Cracking of Straight Run Naphtha Over ZSM-5, ZSM-12 and USY

| | Catalyst | | |
|---|---|---|---|
| | ZSM-5 | ZSM-12 | USY |
| | Example | | |
| | 1A | 1B | 1C |
| Total $iC_4$-$iC_5$ | 6.7 | 10.8 | 34.3 |
| Total $nC_3$-$C_5$ | 23.0 | 19.5 | 15.8 |
| Total $C_1$-$C_2$ | 5.8 | 3.1 | 2.6 |

At a comparable conversion level of 43 wt %, ZSM-12 and ZSM-5 exhibit very high selectivity for $C_5$-olefin production (66% $C_2=-C_5=$). Large pore zeolite USY provides lowest light olefin C5- products (about 47%). However, the USY catalysts yields the highest iso-paraffins (34.3% $iC_4$-$iC_5$) compared to those obtained from intermediate-pore zeolites (10.8% with ZSM-12 and 6.7% with ZSM-5).

EXAMPLE 2

To illustrate the advantage of using large-pore zeolites in a naphtha cracking process followed by iso-paraffin dehydrogenation, selectivity obtained with the state-of-the-art dehydrogenation processes (e.g. UOP Oleflex or Phillips STAR) is taken at a maximum value of about 80% from $iC_4$-$iC_5$ to $iC_4=-iC_5=$. The overall yields of iso-cracking/dehydrogenation process are shown as follows:

TABLE 2

| | ZSM-5 | ZSM-12 | USY |
|---|---|---|---|
| $C_5$— Conversion, wt % | 43 | 43 | 48 |
| OVERALL YIELDS, wt % | | | |
| Naphtha Cracking | | | |
| Total $iC_4=$ -$iC_5=$ | 5.4 | 7.1 | 4.5 |
| Total $iC_4$-$iC_5$ | 2.9 | 4.6 | 16.5 |
| Naphtha Cracking/Dehydrogenation | | | |
| Total $iC_4=$ -$iC_5$ | 7.7 | 10.8 | 17.7 |

Thus, the combined naphtha cracking/dehydrogenation process provides higher yields of iso-butylene/iso-amylene than those obtained from naphtha cracking alone. However, the use of large-pore zeolites in naphtha cracking step enhances the yields of the desirable iso-olefins for MTBE/TAME production.

Fluidized bed configuration is preferred in the primary stage cracking reaction, particularly at high temperature (800°-1200° F.) and short-contact time (<10 sec) conditions, preferably at 0.5 to 5 second catalyst contact. The "fast fluidized" bed reactory type is particulary advantageous in that the contact time can be controlled by design and operation of the riser portion of the reactor, with catalyst regeneration and recirculation being achieved in a continuous reactor operation. Moving-bed and fixed-bed reactors are also viable for high activity and stable catalysts which might not require frequent regeneration. Prefered process conditions for moving bed or fluidized bed configuration would be at reaction temperature of 425° C. to 600° C. (767°-1112° F.), low space velocities (0.25-3 WHSV) and in the substantial absence of added hydrogen. Relatively small amounts of hydrogen may be added in fixed bed reactors to prevent excessive coke formation.

The process may be optimized by zeolite catalysis to produce maximum total isomeric aliphatics. Selective naphtha cracking has shown to be an attractive process to produce various light olefins for ether manufacture. However, the combined naphtha cracking/dehydrogenation process enhances the production of iso-olefins for MTBE/TAME manufacture, thus providing cost-effective alternative to naphtha reforming for the production of clean fuels, particularly if limitations are placed on the aromatic level of gasoline pool.

Various modifications can be made to the system, especially in the choice of equipment and non-critical processing steps. While the invention has been described by specific examples, there is no intent to limit the inventive concept as set forth in the following claims.

We claim:

1. A process for upgrading paraffinic naphtha to high octane fuel comprising;
   contacting a fresh naphtha feedstock stream containing a major amount of C7+ alkanes and naphthenes with medium pore acid cracking catalyst under low pressure selective cracking conditions effective to produce a cracking effluent containing C4–C5 isoalkenes and C4–C5 isoalkanes, said cracking catalyst being substantially free of hydrogenation-dehydrogenation metal components and having an acid cracking activity less than 15;
   separating said cracking effluent to obtain an olefinic fraction rich in C4–C5 isoalkenes and a paraffinic fraction rich in C4–C5 isoalkanes and a C6+ liquid fraction of enhanced octane value;
   dehydrogenating the C4–C5 isoalkanes to produce additional C4–C5 isoalkenes; and
   etherifying the C4–C5 isoalkene fraction and said dehydrogenated additional C4–C5 isoalkenes by catalytic reaction with lower alkanol to produce tertiary-alkyl ether product.

2. A process for upgrading paraffinic naphtha to high octane fuel according to claim 1 wherein the fresh feedstock contains at least 20 wt % C7–C12 alkanes, at least 15 wt % C7+ cycloaliphatic hydrocarbons, and less than 40 wt % aromatics; the cracking conditions include total pressure up to about 500 kPa, space velocity greater than 1/hr WHSV, and reaction temperature of about 425° to 650° C.; the cracking catalyst comprises medium or large pore metallosilicate zeolite; and wherein the cracking reaction produces less than 5 wt % C2- light gas based on fresh naphtha feedstock.

3. A process for upgrading naphtha comprising predominantly alkanes and/or naphthenes according to claim 2 wherein the cracking catalyst consists essentially of zeolite Y; the cracking reaction is maintained at about 450° to 540° C. and weight hourly space velocity of about 1 to 100/hr; and wherein the fresh feedstock consists essentially of C7+ paraffinic virgin petroleum naphtha boiling in the range of about 65° to 175° C.

4. A process for upgrading paraffinic naphtha to high octane fuel according to claim 1 wherein a C6+ fraction recovered from cracking effluent is recycled with fresh feedstock for further conversion under cracking conditions; and wherein isobutene and isoamylenes recovered from naphtha cracking and dehydrogenation are etherified with methanol to produce methyl t-butyl ether and methyl t-amyl ether.

5. A process for upgrading paraffinic naphtha to high octane fuel by contacting a fresh virgin naphtha feedstock stream containing predominantly C7–C12 alkanes and naphthenes with a fluidized bed of solid large pore acid zeolite cracking catalyst under low pressure selective cracking conditions effective to produce at least 5 wt % C4–C5 isoalkanes, said cracking catalyst being substantially free of hydrogenation-dehydrogenation metal components; and separating cracking effluent to obtain a light olefinic fraction rich in C4–C5 isoalkanes.

6. A process for upgrading paraffinic naphtha to high octane fuel according to claim 5 wherein the fresh feedstock contains at least 15 wt % C7+ cycloaliphatic hydrocarbons and less than 20 wt % aromatics; the cracking conditions include total pressure up to about 500 kPa and reaction temperature of about 425° to 650° C.; the cracking catalyst comprises ultra-stable aluminosilicate zeolite Y having an acid cracking activity less than 15.

7. A process for upgrading paraffinic naphtha to high octane fuel according to claim 5 wherein petroleum naphtha containing aromatic hydrocarbon is hydrotreated to convert aromatic components to cycloaliphatic hydrocarbons to provide fresh feedstock containing less than 5 wt % aromatics.

8. The process of claim 5 wherein the fluidized bed catalyst is contacted with the feedstock in a vertical riser reactor during a short contact period which is sufficient to produce said at least 10 wt % $C_4$–$C_5$ isoalkenes in a transport regime and therefor, wherein said catalyst is separated from said isoalkylenes and is recycled to said upgrading step.

9. The process of claim 8 wherein said cracking reaction is carried out in the substantial absence of added hydrogen; wherein the contact period is less than 10 seconds; and wherein the space velocity is greater than 1, based on active zeolite catalyst solids.

10. A process for upgrading paraffinic naphtha to high octane fuel comprising:

contacting a fresh paraffinic petroleum naphtha feedstock stream having a normal boiling range of about 65° to 175° C. with a first fluidized bed of medium or large pore acid zeolite cracking catalyst under low pressure selective cracking conditions effective to produce a cracking effluent containing at least 10 wt % selectivity C4–C5 isoalkenes, said cracking catalyst being substantially free of hydrogenation-dehydrogenation metal components and having an acid cracking activity less than 15;

separating said cracking effluent to obtain a light olefinic fraction rich in C4–C5 isoalkenes, an intermediate paraffin fraction rich in isobutane and isopentene, and a C6+ liquid fraction of enhanced octane value;

dehydrogenating the intermediate paraffin fraction to obtain additional isobutene and isopentene; and etherifying the C4–C5 isoalkene fraction and said additional isobutene and isopentene by catalytic reaction with lower alkanol to produce tertiary-alkyl ether product.

11. A process for upgrading paraffinic naphtha to high octane fuel according to claim 10 wherein the fresh feedstock contains about C7–C10 alkanes cycloaliphatic hydrocarbons, and is substantially free of aromatics; the cracking conditions include total pressure up to about 500 kPa and reaction temperature of about 425° to 650° C.; the cracking catalyst comprises metallosilicate zeolite having a constraint index of about 1 to 12; and wherein the cracking reaction produces less than 5 wt % C2- light gas based on fresh naphtha feedstock.

12. A process for upgrading paraffinic naphtha to high octane fuel according to claim 11 wherein the cracking catalyst comprises ultrastable zeolite Y; the cracking reaction is maintained at about 450° to 540° C. and weight hourly space velocity of about 1 to 4; and including the additional step of recovering volatile unreacted isoalkene and alkanol from etherification effluent and contacting the volatile effluent with a second fluidized bed of medium pore acid zeolite catalyst under olefin upgrading reaction conditions to produce additional gasoline range hydrocarbons.

13. A process for upgrading paraffinic naphtha to high octane fuel according to claim 10 wherein cracking effluent is fractionated to obtain a $C_6$+ fraction, and at least a portion of the $C_6$+ fraction from cracking effluent is recycled with fresh feedstock for further conversion under cracking conditions; and wherein isobutene and isoamylene recovered from naphtha cracking are etherified with methanol to produce methyl t-butyl ether and methyl t-amyl ether.

14. A process for upgrading naphtha-range C7+ paraffinic hydrocarbon to isoalkene-rich product including the steps of:

contacting the hydrocarbon feedstock with acid zeolite cracking catalyst under low pressure selective cracking conditions and reaction temperature of about 425° to 650° C. to provide a cracking effluent containing at least 10 wt % selectivity to C4–C5 isoalkene; said cracking catalyst comprising large or medium pore aluminosilicate zeolite selected from ZSM-5, ZSM-11, ZSM-12, MCM-22, zeolite beta, USY and mixtures thereof with one another and said cracking catalyst being substantially free of hydrogenation-dehydrogenation metal components;

separating said cracking effluent to obtain a light olefinic fraction rich in C4–C5 isoalkene, an intermediate paraffin fraction rich in C4–C5 isoalkanes, and a C6+ liquid fraction of increased octane value, said cracking effluent containing less than 5 wt % C2- light cracked gas;

dehydrogenating said intermediate paraffin fraction to obtain additional C4–C5 isoalkenes in amount sufficient to produce at least 40% selectivity of total C4–C5 isoalkenes based on weight of converted naphtha.

15. A process for upgrading naphtha to high octane fuel according to claim 14 wherein fresh feedstock is selected from virgin straight run petroleum naphtha, hydrocracked naphtha, coker naphtha, visbreaker naphtha, and reformer extract raffinate contains at least 15 wt % and C7+ cycloaliphatic hydrocarbons and about 1 to 40 wt % aromatics; the cracking conditions include total pressure up to about 500 kPa, said aluminosilicate zeolite having an acid cracking activity less than 15.

16. The process of claim 14 wherein fluidized bed catalyst comprising said aluminosilicate zeolite is contacted with paraffinic petroleum naphtha feedstock in a vertical riser reactor during a short contact period which is sufficient to produce said at least 10 wt % $C_4$–$C_5$ isoalkenes selectively in a transport regime, wherein said catalyst is separated from said isoalkylene and is recycled to said upgrading step.

17. The process of claim 16 wherein the contact period is less than 10 seconds, and the space velocity is greater than 1 hr, based on active zeolite catalyst solids.

* * * * *

UNITED STATES PATENT AND TRADEMARK OFFICE

CERTIFICATE OF CORRECTION

PATENT NO. : 5,160,424

DATED : November 3, 1992

INVENTOR(S) : Le et al.

It is certified that error appears in the above-identified patent and that said Letters Patent is hereby corrected as shown below:

Abstract, line 2, "C7-C22" should be --C7-C12--.

Column 9, lines 45-46, "isopentene" should be --isopentane--.

Signed and Sealed this

Twelfth Day of October, 1993

*Attest:*

*Attesting Officer*

BRUCE LEHMAN

*Commissioner of Patents and Trademarks*